United States Patent [19]

Ancillotti

[11] Patent Number: 4,708,128

[45] Date of Patent: Nov. 24, 1987

[54] STATIONARY BICYCLE WITH INCLINABLE PEDAL CRANK AXES FOR TREATING KNEE ANOMALIES

[76] Inventor: Enrico Ancillotti, Viale M. Fanti 9/A, 50137 Firenze, Italy

[21] Appl. No.: 787,765

[22] Filed: Oct. 15, 1985

[30] Foreign Application Priority Data

Oct. 26, 1984 [IT] Italy ..... 9525 A/84

[51] Int. Cl.[4] ..... A61H 1/02

[52] U.S. Cl. ..... 128/25 R; 272/73

[58] Field of Search ..... 128/25 R, 25 B; 272/73; 74/594.1, 594.3, 594.4, 595

[56] References Cited

U.S. PATENT DOCUMENTS 2,413,351 12/1946 Herrick ..... 128/25 R
2,641,249 6/1953 Brockman ..... 128/25 R
2,815,020 12/1957 Barkschat ..... 128/25 B

FOREIGN PATENT DOCUMENTS 208406 10/1923 United Kingdom ..... 272/73
2139513 11/1984 United Kingdom ..... 272/73

*Primary Examiner*—Richard J. Apley
*Assistant Examiner*—J. Welsh
*Attorney, Agent, or Firm*—Hopgood, Calimafde, Kalil, Blaustein & Judlowe

[57] ABSTRACT

A kinesitherapic apparatus for the resolution of "valgus" and "varus" knee anomalies of children and youths, is provided in the form of a stationary bicycle with braked flywheel, wherein the pedal cranks are mounted on separate stub shafts that are inclinable independently so that the upper plane of the pedal can be rotated outwardly or inwardly. The stub shafts are joined to two sectors adjusted by pinions interconnected through gear reduction to hand wheels. A fixture secured to each pedal receives the foot and leg of the operator to maintain alignment.

11 Claims, 6 Drawing Figures

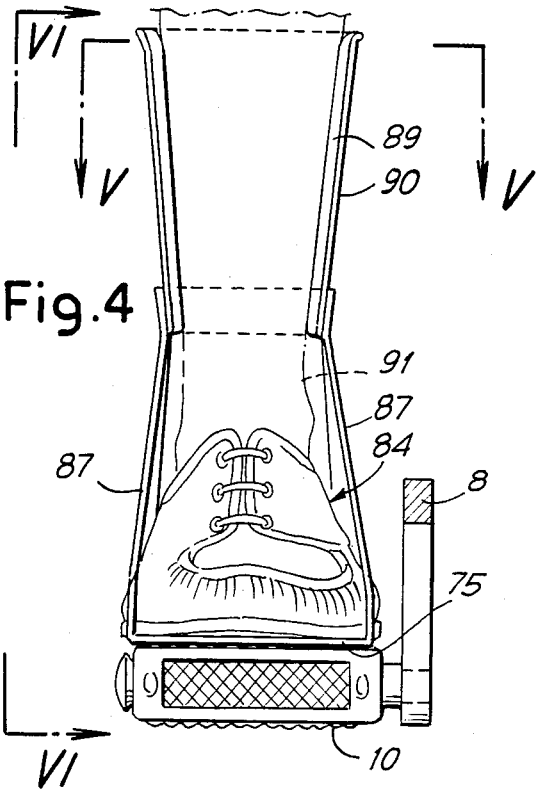
Fig.4
Fig.5
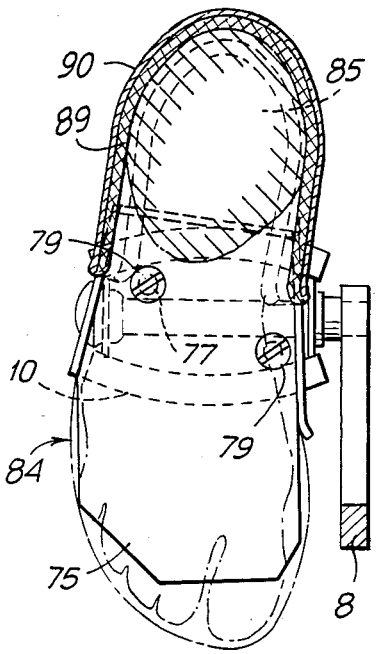
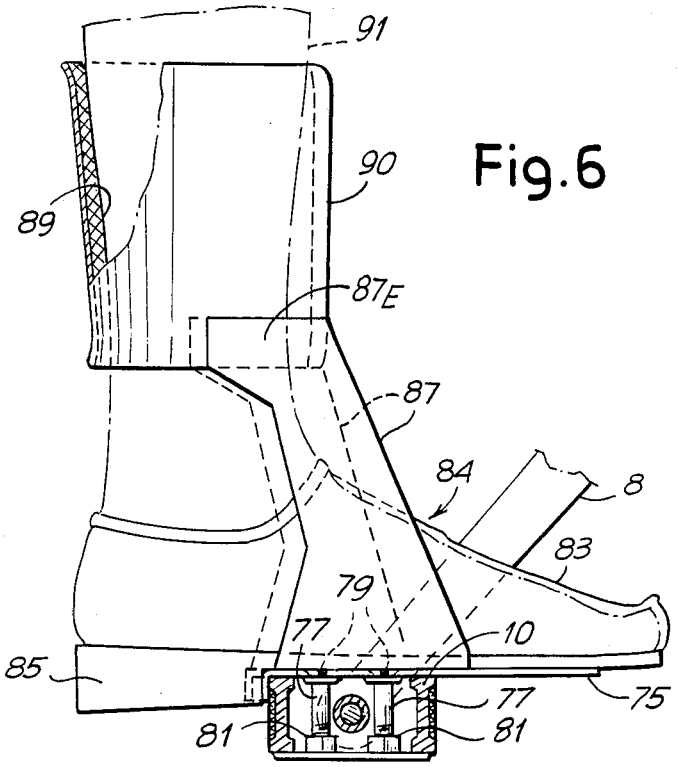
Fig.6

STATIONARY BICYCLE WITH INCLINABLE PEDAL CRANK AXES FOR TREATING KNEE ANOMALIES

DESCRIPTION

The object of the invention is an apparatus for remedial gymnastics, that is, for kinesitherapy, particularly suitable to remedy anomalies known as "valgus knee" and "varus knee", which occur somewhat frequently during childhood and whose treatament may be quite successful if it is carried out in early childhood. The apparatus according to the invention is a stationary bicycle without wheels and provided with a flywheel having an adjustable brake, similar to the bicycles commonly used for home gymnastics or for training. The apparatus is supplied with pedal cranks whose axes are inclinable in an independent way so that the pedal upper plane may be rotated so as to have an inclination outwardly or inwardly of the apparatus through a certain angle which tends to eliminate the angular anomaly between the femoral axis and the tibial axis in the above mentioned "valgus" and "varus" knee defects.

The kinesitherapy obtainable through the apparatus of the invention may be pesonalized and enables repeated exercises that the child peforms willingly since he or she has to pedal like on a conventional bicycle. Similarly to a stationary bicycle for home exercise, the apparatus may be supplied with a tachometer and odometer located on the handlebar.

According to the invention, a kinesitherapic apparatus for the resolution of "valgus" and "varus" knee anomalies in children and youths and for integrating therapies of grown-up people is provided in a form resembling a stationary bicycle, supplied with a braked flywheel, in which the pedal crank axes may be inclined independently; as a consequence, the upper plane of the pedal can, in use, be rotated to become inclined either outwards or inwards, means being provided to control and to adjust the inclination of said axes and means being provided to maintain said inclination stable; moreover, means are provided to keep the foot, while on the pedal, in alignment with the leg, while rotation of the flywheel caused by the pedals movement is achieved through drive means constructed to allow said inclination of the pedal cranks.

Advantageously, according to the invention, the inclination of the pedal cranks is obtained by fixing them at the end of outwardly directed short shafts supported and engaged within respective hubs radially secured to rods hinged to the bicycle frame so as to rotate about a horizontal longitudinal axis; the rotation of the hinged rods being controlled by suitable adjusting means.

The invention will be better understood by a reading of the following description in conjunction with the accompanying drawing which shows a practical, non limitative exemplification of the invention. In the drawing:

FIG. 4 shows a front view of the blocking system of the foot to the pedal of the apparatus; and FIGS. 5 and 6 show views taken on lines V—V and VI—VI, respectively, of FIG. 4.

Figure 1:
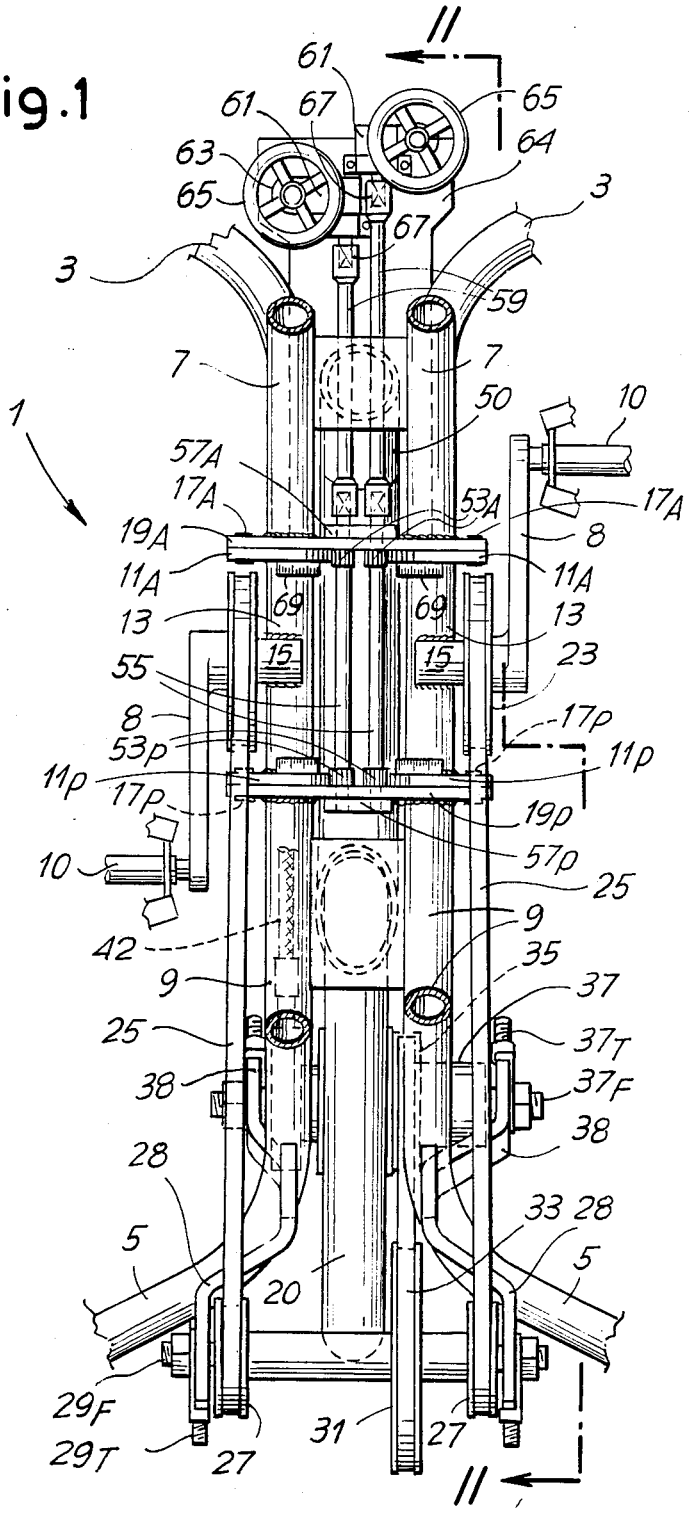
FIG. 1 shows schematically a top view of the apparatus for kinesitherapy according to the invention.

As shown in the accompanying drawing, the kinesitherapic apparatus according to the invention, generally indicated by 1, is realized like a common stationary bicycle devoid of wheels, that is, supported by front legs 3 and back legs 5, both supplied with feet 3P and 5P to avoid slipping. Usually, to legs 3 and 5, front shaped tubes 7 are welded to which a handlebar (not shown) and back shaped tubes 9 for supporting a saddle (also not shown) are secured. In the common stationary bicycles for physical exercise, rotating pedals 10 cause rotation of a flywheel 20 braked by a brake 21 that is adjustable from the handlebar. In said bicycles, the pedal cranks 8 rotate about a common horizontal axis.

Typically, in the apparatus according to the invention, the axes of the pedal cranks 8 are independently inclinable, so that the axis and, thus, the upper plane of each pedal 10 can be rotated to incline either outwardly or inwardly of the apparatus with respect to the usual horizontal plane, the upper plane of the pedal thus forming a given angle with respect to the vertical middle plane of the bicycle. The inclination of said axes is adjustable. In addition, in order that the inclination of the pedal upper plane may cause a corresponding inclination of the leg, without any rotation of the foot relative to the ankle, means are provided to keep the leg in orthogonal position relative to the upper plane of the pedal on which the foot rests during use, that is, to keep the foot lined up with the leg.

Figure 2:
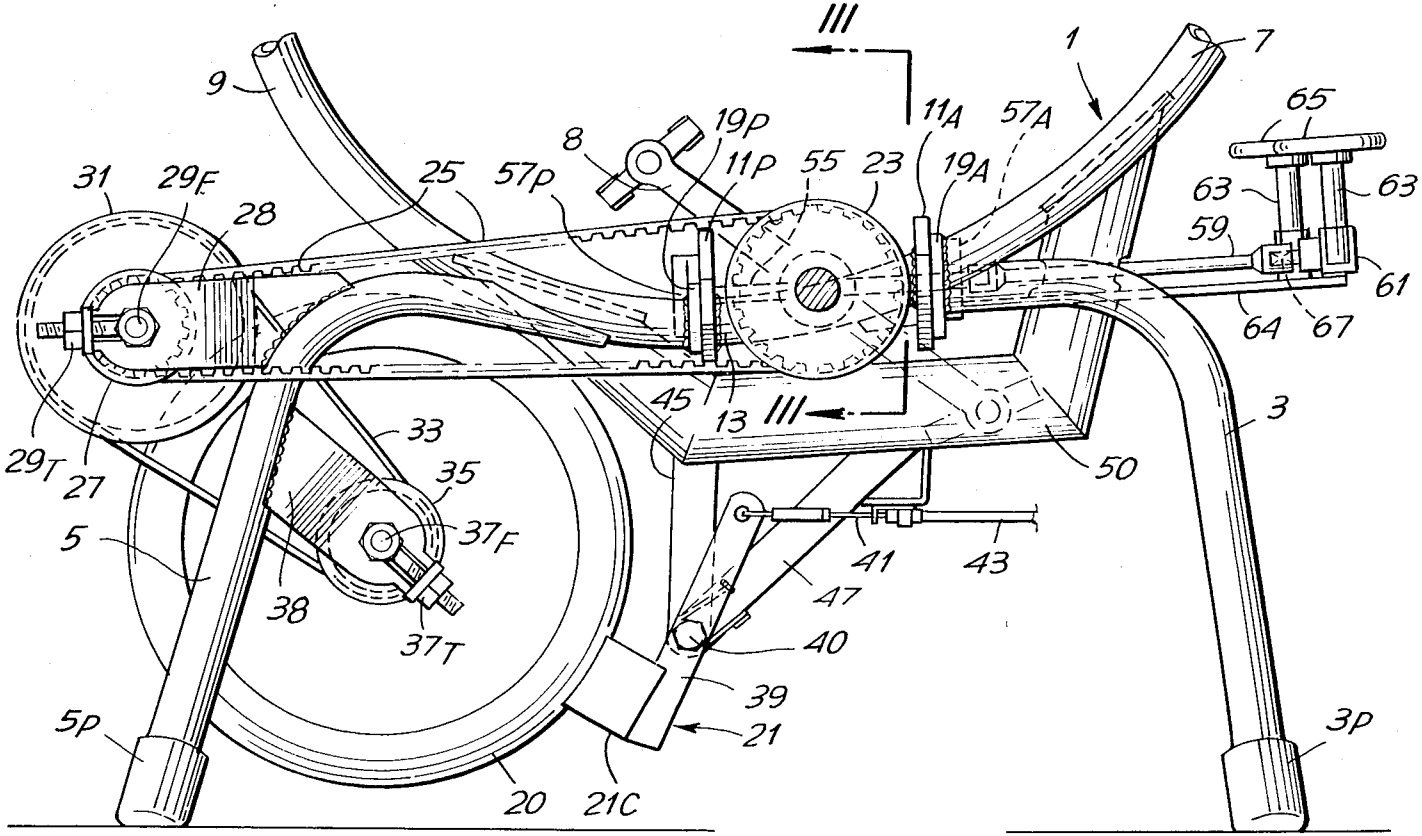
FIG. 2 shows a side view on line II—II of FIG. 1.
Figure 3:
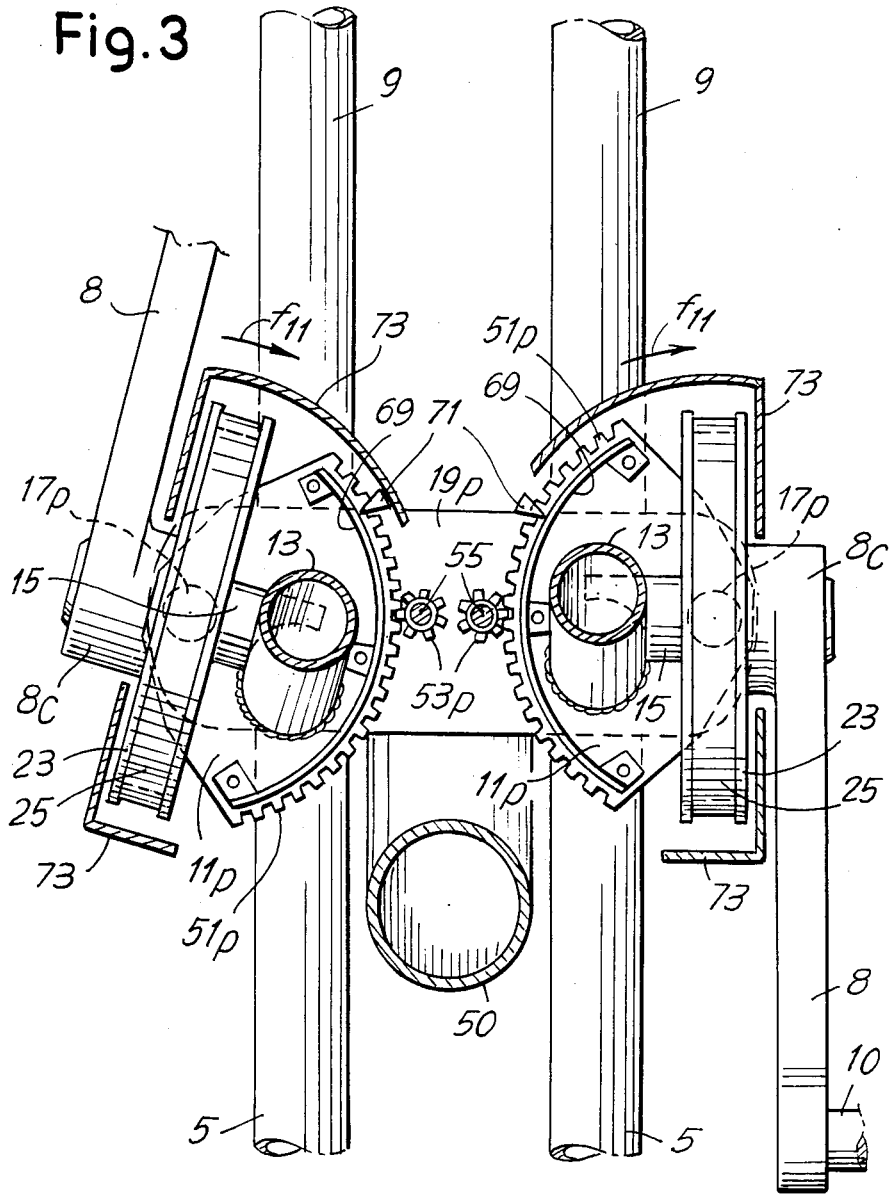
FIG. 3 shows a schematic sectional view on line III—III of FIG. 2.

More specifically, as shown in FIGS. 1, 2 and 3, the independent adjustable inclination of the pedal crank axes 8 is obtained through the joint rotation, for each side of the apparatus, of front and back sector members 11A and 11P with which a short rod 13 is connected. To the rod 13, which is curved upwards, in the example of the drawing, to continue the curvature of tubes 7 and 9, a bored hub 15 is externallly welded. Within hub 15 is a rotatable short shaft to which is fixed the end 8C of the pedal crank 8 (the end opposite the pedal). Each sector member 11A and 11P is articulated at 17A and 17P for rotation in the direction of arrows F11 or in the opposite direction, by means of pins received into suitable holes of two transverse front and back plates 19A and 19P, vertically disposed, and fixed to tubes 3, 7 and 5, 9 respectively of the frame. Means are also provided so that the short shaft, around which each pedal crank 8 rotates, is supported with greatly reduced friction inside the bore of hub 15 and is constrained against (by elastic rings or the like) coming out of said bore. As shown in FIG. 3, the pivot 17A, 17P is so positioned that inclination of the pulley 23, as will be explained later, along with inclination of the axis of pedal crank 8, occurs approximately about the axis of pivot 17A, 17P, such that an excessive lowering or raising of pedal 10 with respect to its usual horizontal position does not occur.

Since the axes of rotation of the pedal cranks are made independent, to convey motion to the flywheel, toothed-race pulleys 23 are respectively provided, located inwardly with respect to each pedal crank 8, coaxial and integral therewith, which pulleys, through toothed belts 25, convey motion to other toothed-race pulleys 27 mounted on a common shaft 29. On the shaft 29 a pulley 31 is mounted which, through a belt 33, transmits motion to a pulley 35 mounted on the shaft 37 of the flywheel 20. Both shaft 29 and shaft 37 are tubular and rotate on bearings carried by respective fixed axes 29F and 37F, upon each of which, pairs of "belt-stretcher" devices 29T and 37T act. Both the fixed axis 29F and the one indicated by 37F are housed in longitudinal slots formed at the ends of pairs of shaped appendixes 28 and 38 fixed at the back and below the tubes 5 of the frame. The belts 25 and the pulleys 23, 27 are toothed because, in use, the pedal cranks are required to rotate in diametral opposition and, to maintain the relative phase situation, slipping of the respective belt transmissions 23, 25, 27, cannot be allowed. Possible phase-differences may, however, be corrected.

As in a usual stationary bicycle, rotation of the flywheel 20 is braked by a shoe 21C of a brake 21, which is operated by a lever 39 on the end of which, at the opposite side of the fulcrum 40, a tie wire or tension rod 41 acts whose tension may be increased or decreased by an adjusting device situated on the handlebar (not shown). The tie wire 41 slides within a sheath 43. The fulcrum 40 of lever 39 is supported by brackets 45, 47 which project below a box shaped bracing which connects the tubes 9 with the tubes 7 of the frame.

As shown in FIG. 1, from the shaft 27 of the flywheel, through a suitable reduction gear shown in dashed lines, a cable received in a sheath 42 proceeds, which cable operates the usual tachometer with odometer, located on the handlebar of the apparatus.

The rotation of the sector members 11A and 11P as a unit around the mutual horizontal axis of pins 17A and 17P, is controlled in a manner to be described later so as to obtain a fine adjustment of the inclination of the pedal crank axes 8 according to the gravity of the defect, for example, of the valgus condition to be corrected, in order the remedial exercise is best suited to achieve the desired correction. For such rotation, the sector members 11A and 11P are provided with peripheral toothing 51A and 51P which mesh with pinions 53A and 53P having small diameter, through which a considerable speed reduction is achieved. The pinions 53A and 53P, for each pair of sectors 11A and 11P, are fixed—on the confronting sides of plates 19A and 19P but close to them—on shafts 55 which are rotatable within bushings formed in plates 57A and 57P that are secured outwardly of plates 19A and 19P with respect to the open space between the plates. The rotation of shafts 55 is controlled through drive rods 59, connected to the driven shafts 67 of respective small reduction gears 61 whose input shaft 63 is caused to rotate by a respective handwheel 65. The reduction gears 61 are mounted, in staggered position (as shown in the drawing) for reasons of overall size economy, on a horizontal plate 64 centrally fixed between the horizontal portions of the front legs 3 of the frame. Both the shafts 55 and the driven shafts 67 have, at facing ends, portions with square cross-section which engage into respective axial cavities, also with square cross-section, formed within radial enlargements provided on both ends of drive rods 59. The transmission ratio of the reduction gears 61 also provides considerable speed reduction and opposes reverse motion. Consequently, there is the advantage of a very fine adjustment and the certainty that the inclination will be maintained unchanged in spite of the effort exerted upon the pedals. The magnitude of such inclination, in one direction or the other, may be determined by a graduated scale 69, generally of cylindrical shape, fixed inside the sector members 11A or 11P (as shown in the drawing), a suitable fiducial mark 71 being located on plates 19A or 19P, for example.

In order to make adjustment of said inclination easier for the operator, rotation of the driving shafts 63 of the reduction gears 61 may be provided also by transferring the handwheels 65 to the handlebar and connecting their stem to the shafts 63 through suitable flexible transmissions or equivalent means. Means for locking rotation of the handwheels 65 may also be provided to avoid undesired tampering.

For safety reasons, the pulleys 23 and the upper end lower branches of the toothed belts 25 are protected by suitable guards 73—inclinable along with said pulleys—fixed, for example, to the sector members 11A and to brackets projecting upwardly from rod 13. This arrangement is in order to avoid interference with the pedal cranks 8 even in case of relatively slight inclination of their axes. The guards 73 may be configured to render the scales 69 visible. Also the pulley 31, the rear pulleys 27 and the upper and rear portion of belt 33 are protected by a suitable guard (not shown).

FIGS. 4, 5 and 6 illustrate the means provided, according to the invention, to ensure that the user's foot, resting on the pedal, is maintained lined up with the leg. Such means consist of a plate 75, disposed in contact with the upper part of the pedal 10 and fixed thereto by bolts 77. The bolts 77 have a countersunk head embedded into suitable countersinks formed on the plate 75, and the nuts 81 for bolts 77 are embedded inside the lower face of pedal 10. The width and length of plate 75 are such as to accommodate on said plate the portion 83 of s hoe 84 which projects forward relative to the heel 85. From the sides of plate 75 two stanchions 87 of laminar material—shaped as shown in FIG. 6—project upwards, convergent to each other and inclined backwardly of the pedal. At the upper ends 87E of stanchions 87 a U-shaped backing or enclosure 90 is fixed. The enclosure 90 is preferably constituted of an external part usually made of metal sheet welded to said ends 87E, open at the front and covered inside with padding 89 of suitable thickness. The padding 89 is preferably of elastically yieldable material, lined with leather or similar material. As shown in FIG. 4, the enclosure 90 has an upward conical trend. The development in height of stanchions 87, their shaping shown in FIG. 6, the dimensions and development in height of the enclosure 90 are such as to ensure that the foot received inside the shoe 84 is always in alignment with the leg 91 which is partly constrained inside the enclosure 90 where it is housed with a slight clamping. The risk is also avoided of having the patient's malleoli interfere with the pedal crank 8 since the foot remains centered within stanchions 87; also, the shaping of the stanchions is such that said malleoli are positioned rearwardly relative to the stanchions with which they cannot come in contact.

The assembly made up of plate 75, stanchions 87 and enclosure 90 also ensures that the foot and leg cannot remain imprisoned, that is, constrained to the pedal in case of intentional or unintentional abandonment of the apparatus. Such assembly 75, 87, 90 is usually dimensioned to fit the foot and leg sizes most common in children and youth of the most favourable age for the kinesitherapy in order to remedy the above cited anomalies. Besides, the elasticity of the padding 89 allows some adjustment to the leg dimensions. For smaller or larger sizes, interchangeable assemblies 75, 87, 90 may be provided, or, the junction of the enclosure 90 to the upper ends 87E of the stanchions 87 may be detachable thus making said assembly disassemblable with the possibility to fix wider or narrower enclosures 90 on a same plate 75 with stanchions 87. For the removable engagement of the enclosure 90, coulisse means may be provided, or the like, located on the exterior so as not to be dangerous.

The apparatus according to the invention permits, both in cases of valgus knee and those of varus knee, suitable personal kinesitherapic treatment, as will be apparent from the following considerations.

With the knee in valgus condition (that is, when the femoral axis forms an outwardly open angle with the tibial axis), the kinesitherapy has the purpose of developing the muscles which involve the inner face of the knee. The exercises must aim at spreading the knees wide, and at reinforcing said muscles by the flex-adduction of the thigh on the pelvis and the inward rotation of the leg on the thigh in a knee half-bending position. The apparataus according to the invention allows the above-mentioned exercises to be performed and, by inclining the pedals outwards, permits to achieve the right varus-directed correction of the limbs depending on the degree of femoral-tibial valgus condition encountered in the patient and to avoid also a hypo or hyper-correction of the deformity. The very fine adjustment of the inclination of the pedal crank axes in an independent way permits this result. The foot is kept lined up with the leg and, hence, the pedal rotation takes place with the normal thrust of the foot without any rotation of it relative to the ankle.

The pedal rotation takes place on the oblique correction plane which, as mentioned, for the valgus knee, is in varus condition direction, that is, with said plane downhill, outwardly directed from top to bottom.

When the knee is in varus condition, that is, when there is an outward deviation of the knee, thereby the femoral axis forms with the tibial axis an angle having external convexity, the exercises must tend to bring the knees closer with a valgus directed movement by keeping the feet, in a sense, wide open so as to oppose the deformity. In this case, there will occur a gradual stretching of the medial structures and a pressure on the external side of the knee. The apparatus according to the invention permits repeated exercises of the type described to be performed, since it permits, without difficulty, pedalling with the knees inwardly directed, the inclination of the pedal plane (inwardly downhill) being adjustable depending on the gravity of deformity and thus avoiding the occurrence of hypo or hyper-corrections. Also in this case the foot can be kept lined up with the leg without rotation relative to the ankle.

In both types of kinesitherapy, the resistance on the pedals may be changed at will and, hence, it is possible to graduate the effort depending on what the user is in condition to do, with the possibility to increase the muscular force. The foot can wear its normal shoe, the user, sitting on the saddle and being able to hold the handlebar, is in stable equilibrium and has no difficulty pedalling as with a normal bicycle.

The apparatus, in addition to proving most valid for the kinesitherapy of children and youths suffering from valgus or varus knee, may also be useful for adults needing remedial gymnastics, for example, for knees with axis anomaly, for post operative surgical operation, as well as in case of femoral-tibial arthrosis, medial or lateral compartment arthrosis, etc.; it may also be useful in mild forms of spastic paralysis by suitably shifting the pedal plane orientation in order to improve the deambulation.

It is understood that the drawing shows an exemplification given only as a practical demonstration of the invention which may vary in form and disposition without, nevertheless, departing from the ambit of the idea on which the same invention is based.

I claim:

1. A kinesitherapic apparatus for the resolution of "valgus" and "varus" knee anomalies of children and youths and for integrating therapies on grown-up people, comprising in combination a stationary cycle frame with a flywheel, means for braking said flywheel, independently mounted pedal cranks each mounted on said cycle frame for selectable tilting articulation about an axis extending generally horizontally in the fore and aft direction of said cycle frame, means coupled to said pedal cranks for selecting and determining said articulation, respective pedals journaled to said pedal cranks, means coupled to each pedal for positioning a foot on the corresponding pedal in alignment with the associated leg and means for connecting said pedal cranks with said flywheel to impart motion to said flywheel independent of said tilting articulation.

2. Apparatus according to claim 1, wherein said pedal cranks are secured at the outward end of corresponding short shafts each supported and engaged within respective hubs joined to rods pivotally joined to said cycle frame for translation about said axis; and means for adjusting the translation of said rods.

3. Apparatus according to claim 1, wherein said means for selecting and determining said articulation comprises pairs of toothed sectors fixed at opposite ends of rods, said sectors being pivotally secured to said cycle frame, pinion means enmeshed with said sectors for imparting rotation to said sectors, horizontal shafts joined to said pinion means for coupling operator input to said pinion means; a graduated scale, coupled to said toothed sectors for indicating the inclination of the corresponding pedal crank.

4. Apparatus according to claim 3, wherein worm reduction units are drivingly coupled to said horizontal shafts for imparting controlled movement thereto, a handwheel exposed on an input shaft of each said worm unit, and the gear ratio of said worm unit being selected to oppose reverse movement under force communicated to said pedal cranks.

5. Apparatus according to claim 4, wherein said handwheels are mounted proximate to said handlebar and connected by coupling means to said worm units.

6. Apparatus according to claim 1, wherein said means for interconnecting said pedal cranks with said flywheel comprise a first pair of identical toothed race pulleys each disposed inwardly with respect to a corresponding pedal crank to which it is interconnected, another pair of toothed race pulleys mounted on a common shaft located transverse to said frame, toothed belts coupling said first pair of pulleys respectively to said another pair of pulleys, a further pulley mounted on said last mentioned shaft, a pulley secured to said flywheel, a belt connecting said last mentioned pulley with said further pulley, and said pedal cranks being oriented 180° out of phase relative to each other.

7. Apparatus according to claim 6, wherein guards are provided for protecting said toothed pulleys and belts, said guards being mounted to rotate with said tilting articulation of said pedal cranks.

8. Apparatus according to claim 1, wherein said means for positioning a foot comprises a plate secured to each pedal for supporting a shoe which shoe houses the foot of an operator, an upwardly conical horizontally U-shaped receptacle secured to each said plate by two similar stanchions located at the sides of the pedal, said stanchions being shaped and located relative to said plate for avoiding interference with rotation of said pedal crank while avoiding interference between the malleolus and the pedal crank.

9. Apparatus according to claim 6, wherein the interior of said receptacle has an elastically yieldable lining for a slight clamping of the leg of an operator, and said assembly of plate, stanchions and receptacle is replaceable to fit the sizes of the user's limbs.

10. Apparatus according to claim 9, wherein means are provided for removably joining said receptacles to said stanchions.

11. Apparatus according to claim 1, wherein said means for braking said flywheel comprises means proximate to said handlebar for imparting adjustment to said braking means.

* * * * *